US005145007A

United States Patent [19]

Dinkins

[11] Patent Number: 5,145,007

[45] Date of Patent: Sep. 8, 1992

[54] WELL OPERATED ELECTRICAL PUMP SUSPENSION METHOD AND SYSTEM

[75] Inventor: Walter R. Dinkins, Lawrence, Kans.

[73] Assignee: Camco International Inc., Houston, Tex.

[21] Appl. No.: 676,993

[22] Filed: Mar. 28, 1991

[51] Int. Cl.[5] ..... E21B 23/00

[52] U.S. Cl. ..... 166/386; 166/65.1; 166/68.5

[58] Field of Search ..... 166/65.1, 68, 68.5, 166/77, 386; 174/47, 100

[56] References Cited

U.S. PATENT DOCUMENTS

| | | | |
|---|---|---|---|
| 2,798,435 | 7/1957 | Armstrong | 103/5 |
| 3,889,579 | 6/1975 | Wiechowski et al. | 92/3 |
| 4,262,703 | 4/1981 | Moore et al. | 138/115 |
| 4,346,256 | 8/1982 | Hubbard et al. | 174/47 |
| 4,476,923 | 10/1984 | Walling | 166/65 |
| 4,569,392 | 2/1986 | Peterman | 166/242 |
| 4,570,705 | 2/1986 | Walling | 166/77 |
| 4,572,299 | 2/1986 | Vanegmond et al. | 166/385 |
| 4,607,693 | 8/1986 | Richardson | 166/65.1 |
| 4,644,094 | 2/1987 | Hoffman | 174/47 |
| 4,665,281 | 5/1987 | Kamis | 174/102 |
| 4,681,169 | 7/1987 | Brookbank, III | 166/385 |
| 4,718,486 | 1/1988 | Black | 166/68 |
| 4,726,314 | 2/1988 | Ayers | 114/243 |
| 4,743,175 | 5/1988 | Gilmore | 417/361 |
| 4,830,113 | 5/1989 | Geyer | 166/369 |

OTHER PUBLICATIONS

Sandia Report, SAND82-0425, Feb. 1982, entitled "Proceedings—High Temperature Electronics and Instrumentation Conference—Dec. 1981".

*Primary Examiner*—William P. Neuder
*Attorney, Agent, or Firm*—Fulbright & Jaworski

[57] ABSTRACT

A coil tubing electrical power cable system is used to electrically drive a pump in an oil and/or water well. The cable is an insulated electrical conductor enclosed in a low tensile strength corrosion-resistant metal tubing. The tubing has the tensile strength to support the tubing in the electrical conductors. Separate retrievable support means are attached to the motor for supporting the motor and pump in the well. The motor and pump are lowered and set by the support means and the support means is then disconnected and retrieved and is not required to be corrosion-resistant.

13 Claims, 5 Drawing Sheets

WELL OPERATED ELECTRICAL PUMP SUSPENSION METHOD AND SYSTEM

BACKGROUND OF THE INVENTION

It is known to utilize an electrical cable which supplies electrical energy to a downhole motor which drives a submersible pump in an oil and/or water well for pumping fluids. It has been proposed in U.S. Pat. Nos. 4,346,256 and 4,665,281 to utilize an electrical cable having a plurality of insulated conductors enclosed in an outer metallic tube.

One problem not covered is that the metallic tube wall thickness required to support the submersible motor and pumping unit weight in addition to the metal tube and its core weight is not practical using conventional metallurgy technology for use in well depths 8,000 to 12,000 feet deep. The problem lies in the materials used for the outer metallic tube. If a material is selected which has the tensile strength to support both the tube, its core, and the motor and pumping unit, higher strength materials must be used, but the higher strength materials tend to corrode faster in the well which leads to a reduced system life. On the other hand, materials which are corrosion-resistant, do not have the strength to support the metal tube, its core, and motor and pumping unit in well depths 8,000 to 12,000 feet deep.

The present invention provides a solution to this problem by reducing the tensile strength requirements of the metallic coil tube to withstand its own weight and the core weight only. The weight of the submersible pumping system is carried by a separate, retrievable support means which need not be corrosion-resistant. This system allows the use of a metal tubing with practical wall thicknesses using low alloy steels with improved corrosion resistance.

Another problem not considered by the prior art is the effect tensile loads and high temperatures will have on the relative motion of the inner electrical conductors to the outer metallic tube. Insulation materials used for the conductor insulation and jacket allow higher modulus materials, such as copper, to easily elongate and even yield the insulation. This condition is exacerbated over long lengths typically encountered in water and oilwells. The primary failure mechanism in electrical mechanical cables is conductor "z-kinking" whereby the conductors will twist radially leading to electrical failure. This is caused by higher coefficient of thermal expansion of conductors, such as copper or aluminum, versus the tensile member, such as steel, which leads to compressive loading of the conductors. This problem has been overcome by controlling the elongation of the two metal components of this system, the metallic tubing and the electrical conductors to allow optimum performance under tensile load and at elevated temperatures.

SUMMARY

The present invention is directed to a method of setting an electrical motor operated liquid well pump in a well which includes connecting an electrical cable to the motor in which the cable includes a plurality of insulated electrical conductors enclosed in a low tensile strength corrosion-resistant metal tubing. The metal tubing possesses the tensile strength to support the tubing and the electrical conductors. The method further includes attaching a separate retrievable support means to the motor and pump in which the support has the tensile strength to support the motor and pump in the well. The motor and pump are lowered and set in the well by the support means with the electrical cable attached. Thereafter, the support means is disconnected from the motor and pump and retrieved from the well leaving the set pump.

A further object of the present invention is wherein the support means is disconnected by mechanically releasing a releasable catch by lowering the lower end of the support means relative to the pump.

Still a further object of the present invention is wherein the support means is disconnected by fluid pressure actuation of a releasable catch.

Still a further object of the present invention is the method of setting an electrical motor actuated liquid pump in a well by attaching a retrievable support means to the motor, lowering and setting the pump in the well, disconnecting the support means from the motor after the pump is set and retrieving the support means from the well. Thereafter, an electrical cable is lowered and connected to the motor in which the cable is an insulated electrical conductor enclosed in a low tensile strength corrosion-resistant metal tubing.

Still a further object is an electrical motor operated well pump for setting in a well which includes an electrical cable adapted to be connected to the motor in which the cable is one or more insulated electrical conductors enclosed in a low tensile strength, corrosion-resistant metal tubing. The metal tubing has the tensile strength to support the tubing and electrical conductor. Separate retrievable and releasable support means is connected to the motor and pump and the support means has the tensile strength to support the motor and pump in the well. The support means may include a wire rope used temporarily without requiring corrosion-resistant properties or may include a metal tube.

Still a further object of the present invention is wherein the electrical conductors have a lay length of approximately eight to fourteen times the diameter of the insulated conductors. Preferably, the lay length is approximately ten times the diameter of the insulated conductors.

Yet another feature of the present invention is wherein tension actuated releasable catch means connect a wire rope to the motor and pump or a fluid actuated releasable catch means connects a metal tube to the motor and pump.

Still a further object of the present invention is wherein the electrical cable includes one or more hydraulic tubes extending through the cable interiorly of the metal tubing for actuating downhole well equipment.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

Figure 1:
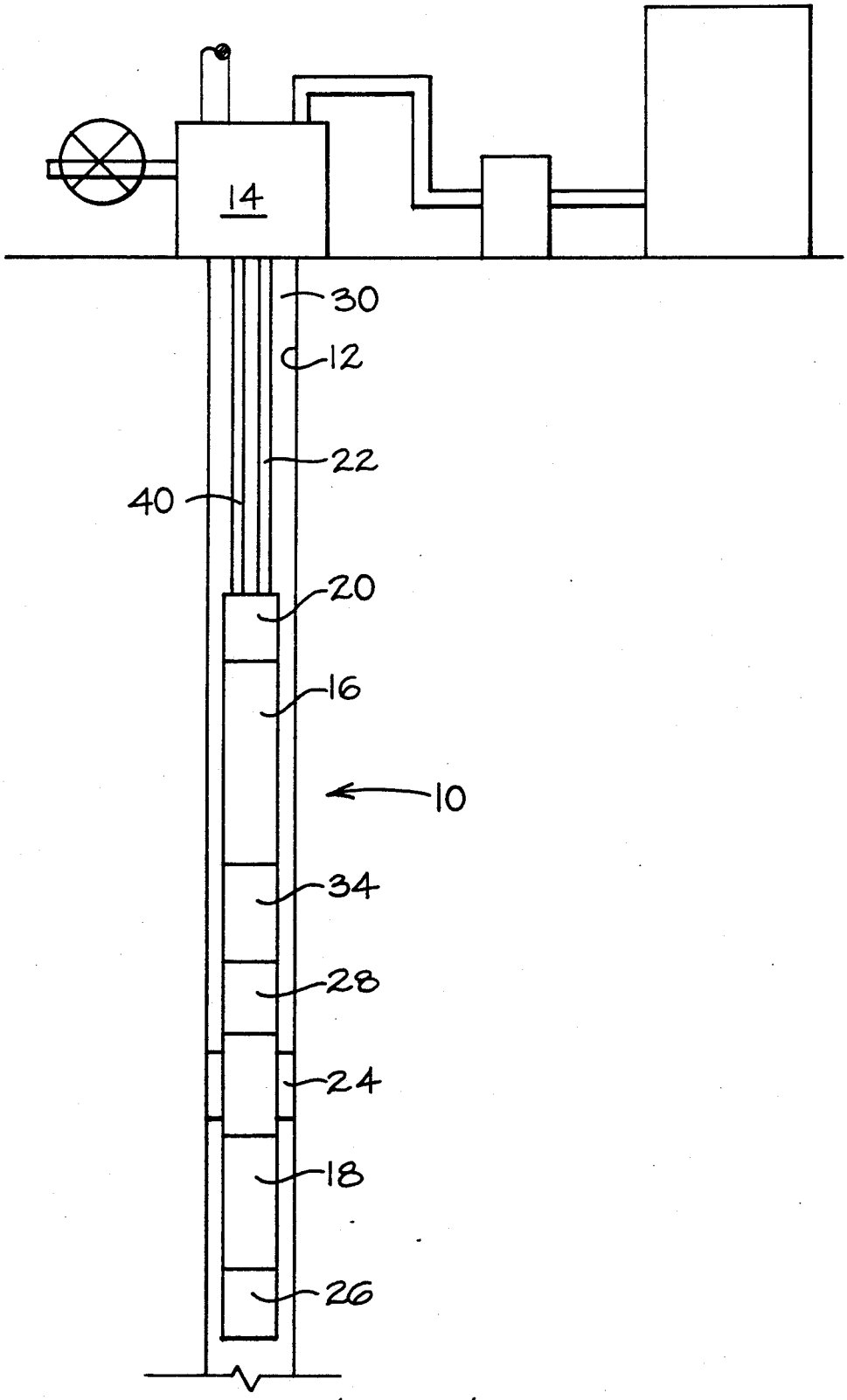
FIG. 1 is an elevational schematic view of the pumping system of the present invention.

Referring now to the drawings, and particularly to FIG. 1, the reference numeral 10 generally indicates a submersible well pumping system of the present invention which is to be installed in a well casing 12 beneath a wellhead 14. The system is installed in the casing and generally includes an electrical motor 16 which supplies rotational energy for a downhole pump 18. A motor protector 34 helps to isolate the motor 16 from mechanical vibrations and well fluids. A motor connector 20 provides a connection between the motor 16 and an electrical supply. The pumping system 10 is lowered into the well casing 12. The pumping system 10 is lowered until reaching a prepositioned shoe 24 which is positioned in the casing 12 and the pumping system 10 is latched into the shoe 24. The shoe 24 also serves to separate the pump intake 26 and the pump discharge 28 sections. Produced well fluid is pumped up the annulus 30 to the wellhead 14. Generally, the above description of a well pumping system is known.

Figure 2:
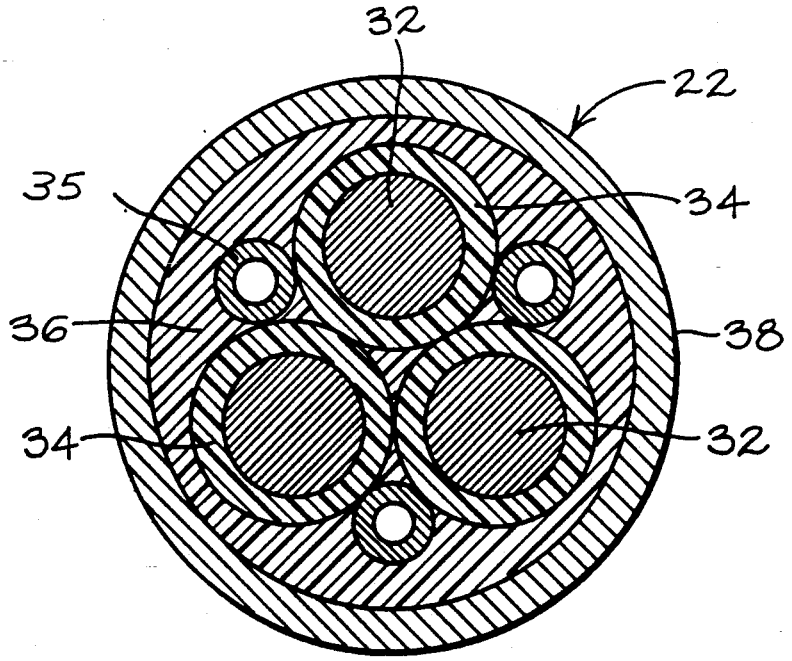
FIG. 2 is an enlarged cross-sectional view of the electrical cable of FIG. 1.

Referring now to FIG. 2, the preferred embodiment of the electrical cable 22 is best seen and is comprised of a plurality of electrical conductors 32, preferably copper, although aluminum is satisfactory. The electrical conductors 32 are preferably of a stranded wire to allow flexibility when twisting two or more of the insulated conductors together.

The electrical conductors 32 are surrounded by a primary insulation 34 and the conductors 32 and insulation 34 are enclosed within a jacket 36 which serves to protect the insulated conductors during manufacture and enclosing within an outer metallic tube 38. In one embodiment, the insulation 34 may be ethylene propylene compound designed for operating in temperatures up to 400° F. In this embodiment, the jacket material 38 is also an ethylene propylene compound with a 400° F. rating. In another embodiment, the insulation 34 may be of propylene thermoplastic and the jacket 36 may be of a high density polyethylene. This second embodiment may be used in shallow wells with low bottom hole temperatures. In still a further embodiment, the insulation 34 may be of polyetheretherketone thermoplastic and the jacket 36 is of fluorinated elastomer such as sold under the trademark "Aflas". This third embodiment construction is useful in wells with high bottom hole temperatures.

The outer metallic tube 38 is preferably made of a standard low tensile strength, low alloy steel, such as ASTM A606, which is welded inline with the electrical power conductors 32, their insulation 34 and swedged over the core jacket 36 for a mechanical grip and to prevent well gases from migrating up the cable core. The forming of the metallic tube 38 is done in two separate sections: preforming a C-shape in a first section allowing placement of the cable core, and a second forming section is used to close the circle for welding.

The strength of the outer metal coil tube 38 will support its own and the cable core weight up to the limit of practical well depths, such as 8,000 to 12,000 feet deep. The yield strength of the outer metal tube 38 will provide an adequate safety margin to allow for corrosion, particularly since the metal is corrosion-resistant, and any added strength to release the pumping unit 10 during retrieval. The design of such a cable 22 can be provided satisfactorily so long as it does not have to meet the tensile strength criteria of supporting not only its own weight, but the weight of the submersible pumping unit 10.

Referring again to FIG. 1, the weight of the submersible pumping system consisting of the motor 16 and pump 18 and its connected parts is supported by one or more, here shown as one, retrievable suspension member 40. The use of a retrievable suspension member 40 allows longer life for the member 40 since it is in corrosive conditions only during the installation of the pumping unit 10 and is thereafter retrieved. By using the retrievable members 40, for supporting the submersible pumping unit, the safety margin for the metal tubing 38, which is typically three to one, can be reduced to two to one or less.

Figure 3:
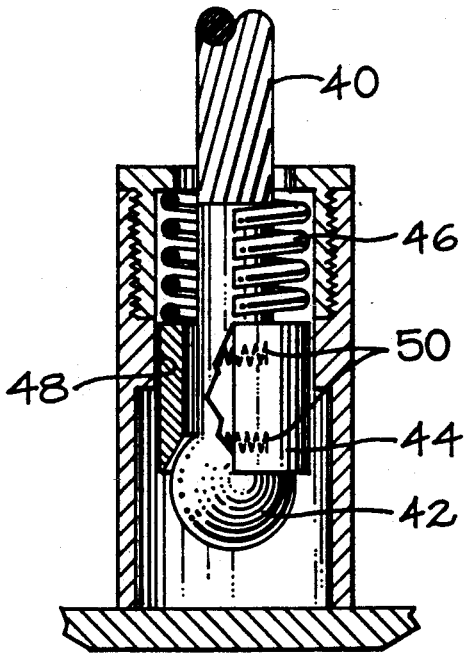
FIG. 3 is an enlarged elevational view, partly in cross section, illustrating the release latch between the support means and the pumping unit of FIG. 1.

The retrievable suspension member or members 40 may be comprised of a wire rope made out of galvanized improved plowshare steel (GIPS) which possesses the necessary tensile strength, but is not particularly corrosion-resistant. The suspension member 40 is releasably connected to the submersible pumping system 10. Once the pumping system 10 is properly set in the shoe 24, the suspension member 40 is released and retrieved. Referring now to FIG. 3, the releasable latch may include a socket 42 connected to the end of the suspension member 40. With tension on the suspension member 40, the socket 42 forces half shells 44 upwardly overcoming a spring 46 to keep the half shells 44 in a restriction 48. Once the pumping system 10 is seated and set, the tension on the suspension member 40 is released allowing the spring 46 to press the half shells 44 downwardly out of the restriction 48. Springs 50 then cause the half shells 44 to separate freeing the rope socket 42 to be withdrawn through the restriction 48. The suspension member 40 is then retrieved for further use.

However, as indicated while coil tubing electrical cable systems have been proposed in the past, they have not been directed to the problem or how to overcome the effects of tensile loads and high temperatures on the relative motion of the inner conductors 32 relative to the outer metallic tube 38. The primary failure mechanism in electrical cables such as cable 22 has been z-kinking of the electrical conductors 32 because of high elongation when the electromechanical cable 22 is under tension followed by compression due to higher thermal expansion of the conductors 32 (and higher temperature due to resistant heating) compared to the metallic tube 38. For example, the coefficient of thermal expansion of copper is 16.E-6 in/in/deg. C. of aluminum is 23.E-6 in/in/deg. C. and of steel is 12.E-6 in/in/deg. C. Thus, the conductors 32 of either copper or aluminum will tend to kink or loop on itself at intervals along the cable 22 during increased temperature changes which results in cable failure.

Figure 4:
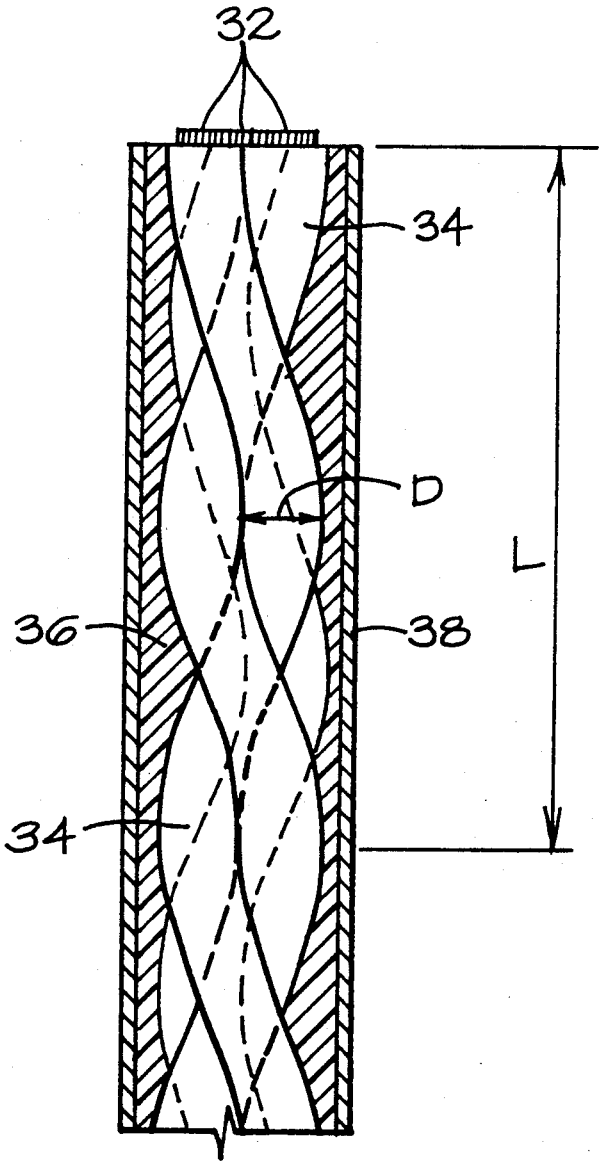
FIG. 4 is an enlarged cut-away view of the cable of FIG. 2.

The present invention is directed to overcome the problem of tensile load and elevated temperatures. Specifically, the difference in elongation of the two metal components, the electrical conductors 32 and the metallic coil tube 38 are closely designed to allow optimum performance. The elongation of the coil tube 38 may be controlled with the wall thickness used. Design constraints for the outer metallic tube 38 include: core weight, coil tube material weight, submersible pumping unit weight, and maximum operating temperature. Design constraints for the cable core include: maximum cable elongation, conductor size, insulated conductor twist factor and maximum operating temperature. The elongation of the electrical conductors 32 is maintained below the materials ultimate yield at the cable maximum load by varying the twist factor or twist lay length which is the length for one of the conductors to twist one revolution or 360°. In the present invention, to minimize the tendency of the electrical conductors 32 to Z-kink, the twist lay length has been reduced to allow the conductors 32 to act more as a spring when subjected to tensile and compressive forces encountered in normal operation. In the present invention, it has been calculated that the lay length L (FIG. 4) should be eight to fourteen times the diameter D of an insulated conductor 34. Preferably, the lay length is ten times the insulated conductor diameter. The effect of reducing the lay length L of the conductors 32 in effect increases the overall length of the conductors 32 and makes the difference in the coefficient of thermal expansion between the conductors 32 and the coil tubing 38 less significant. Because lay angle of conductors is at higher angle to axis of cable, the tensle and compressive forces are expressed in the elastomer core (as a spring) rather than in forcing the conductors to deform radially (forming z-kinks when compressed).

As an example only, the following parameters have been calculated to provide a satisfactory system in a well in which the pumping unit 10 has been installed at a depth of 10,000 feet and the weight of the pumping unit is 6500 pounds supported by the retrievable suspension member 40 and a maximum operating temperature is 400 F. For example, the metallic coil tube 38 had a wall thickness of 0.105 inches, the core weight was 1.23 lbs/ft, the coil tube 38 material weight was 1.33 lbs/ft. For copper twisted conductors 32 of a size #1 AWG, the maximum cable elongation was 0.21%, with an insulated copper twist factor of 10.

Of course, other and further embodiments of the present invention may be utilized. Other embodiments are best seen in FIGS. 5 and 6 wherein like parts to those in FIGS. 1-4 are similarly numbered with the addition of suffixes "a" and "b", respectively.

Figure 5:
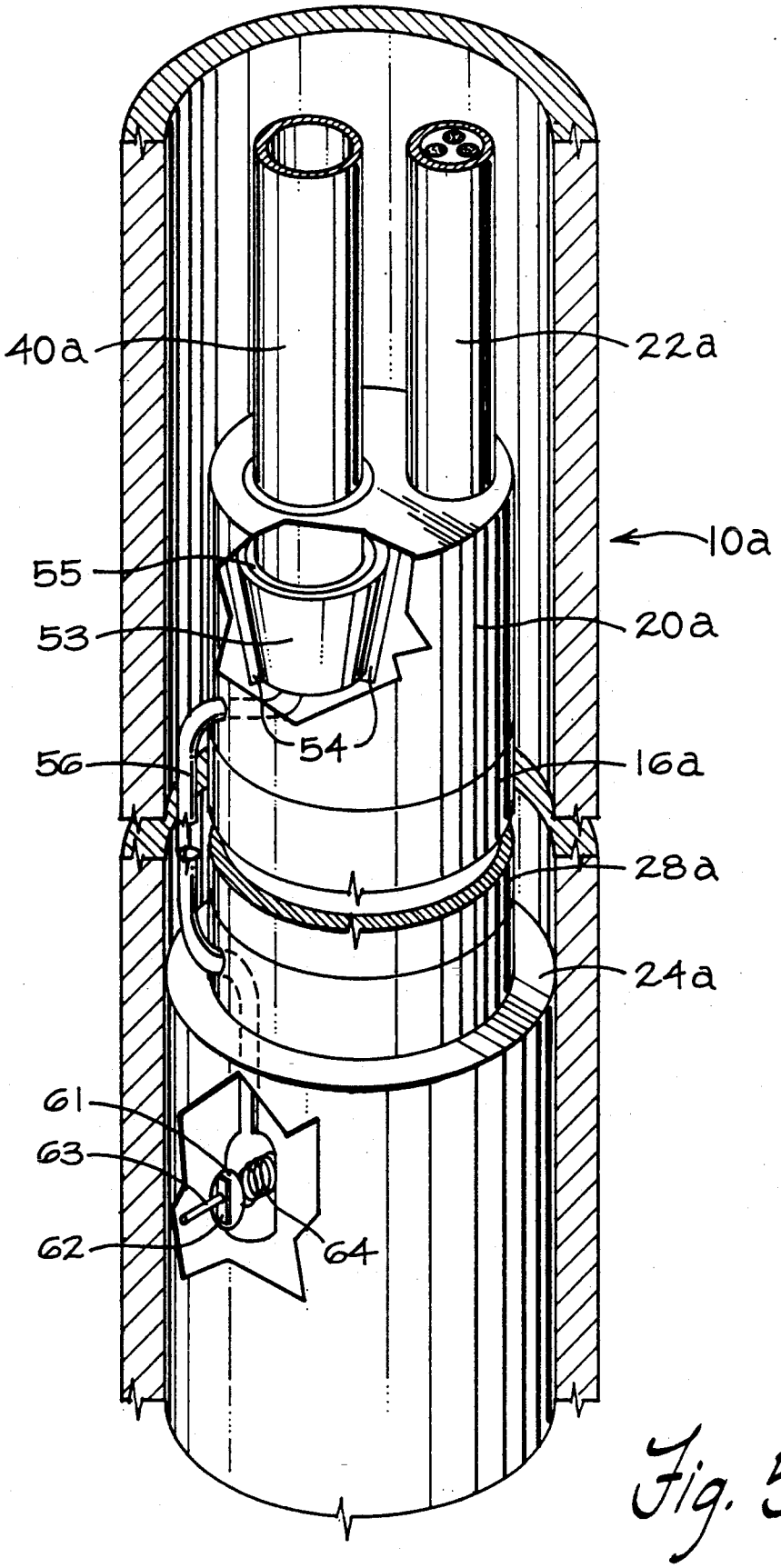
FIG. 5 is an elevational perspective, partly in cross section, illustrating another embodiment of the present invention.
Figure 6:
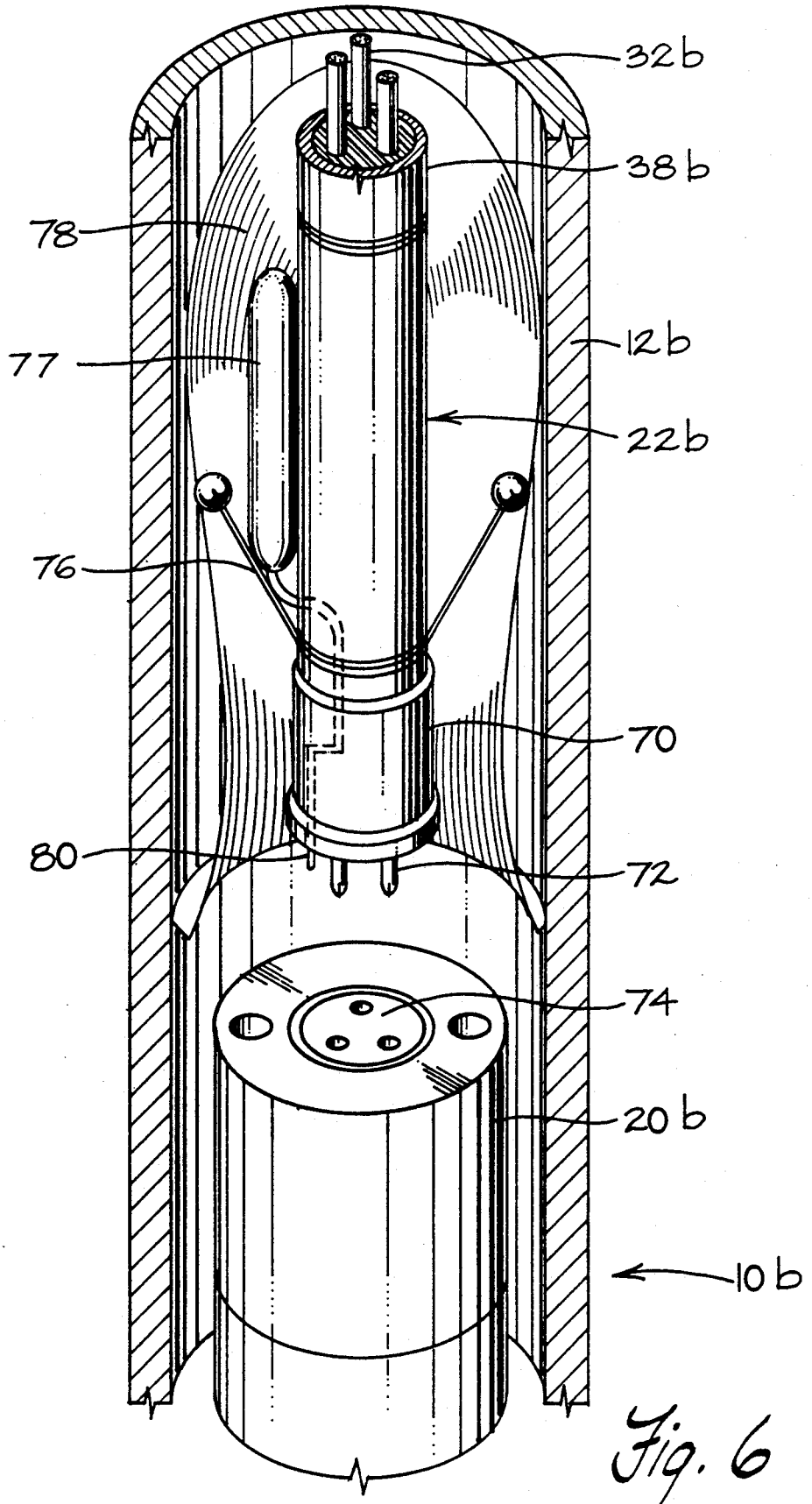
FIG. 6 is a fragmentary elevational perspective view, partly in cross section, of still another embodiment of the present invention.

In FIG. 5, the submersible pumping system **10*a* is connected to a cable system 22*a* and set in a shoe 24*a* similarly to the installation shown in FIG. 1. However, the suspension member 40*a* is a metal coil tubing for supporting the weight of the pumping unit 10 and setting the pumping unit 10 in the shoe 24*a*. The retrievable suspension member 40*a* can be released when a temporary positive pressure applied from the well surface through the interior of the hollow metal coil tubing suspension member 40*a* expands a bladder 53 radially so that circumferential hooks 54 in the motor connector 20*a* release their grip on a lip 55 connected to the bottom of the suspension member 40*a*. In addition, a fluid line 56 may be provided in the pumping unit 10*a* which is connected between the interior of the tubing suspension member 40*a* to transmit positive pressure down to a shoe latch mechanism positioned between the pumping unit 10*a* and the shoe 24*a*. Thus, applied pressure through the line 56 moves diaphragm 61 so that a latch 62 is engaged and pin 63 is injected by pressure from a spring 64 which sets the pumping unit 10*a* in the shoe 24*a***.

The previous two embodiments describe a tandem installation of electromechanical cable and retrievable suspension system. A further embodiment, as best seen in FIG. 6, is for a first installation of the submersible pumping system **10*a* using a retrievable suspension member 40 or 40*a* as previously described followed by the installation of an electromechanical cable 22*b* as shown in FIG. 6. First, the submersible pumping system 10*b* is set using a retrievable suspension system such as member 40 or 40*a* previously described. After setting the submersible pumping system 10*a* in shoe 24*a* and releasing and retrieving the retrievable suspension system, the electromechanical cable 22*a* is installed as best seen in FIG. 6. A connector head 70 is connected to the lower end of the electrical cable 22*b*. The connector head 70 includes male connectors 72 to mate with female connector 74 on the motor connector 20*b*. The male and female connectors 72 and 74 are mated by lowering the cable 22*b* and rotating the cable 22*b* to align the male and female connectors 72 and 74. Rotation of the connector head 70 is accomplished by using a centralizer 76 which coacts with a conventional muleshoe 78 positioned in the casing 12*b*. Electrical integrity is maintained on the connections 72 and 74 by injecting a fluorinated insulating oil positioned in a pressure cylinder 78 and activated by positive contact of a pin 80 with the motor connector 20*b***.

When it becomes necessary to retrieve the submersible pumping system **10*b*, the electrical cable 22*b*** is released and the remaining pumping unit may then be retrieved with conventional fishing equipment.

The present invention, therefore, is well adapted to carry out the objects and attain the ends and advantages mentioned as well as others inherent therein. While presently preferred embodiments of the invention have been given for the purpose of disclosure, numerous changes in the details of construction, and arrangement of parts, will be readily apparent to those skilled in the art and which are encompassed within the spirit of the invention and the scope of the appended claims.

What is claimed is:

1. A method of setting an electrical motor operated liquid well pump in a well comprising, connecting an electrical cable to the motor, said cable being a plurality of insulated electrical conductors enclosed in a low tensile strength corrosion-resistant metal tubing, said metal tubing having the tensile strength to support the tubing and the electrical conductors, attaching a separate retrievable support means to said motor and pump, said support having the tensile strength to support the motor and pump in the well, lowering and setting the motor and pump in the well by the support means with the cable attached, disconnecting the support means from the motor and pump after the pump is set, and retrieving the support means from the well while leaving the set pump.

2. The method of claim 1 wherein the support means is disconnected by mechanically releasing a releasable catch by lowering the lower end of the support means relative to the pump.

3. The method of claim 1 wherein the support means is disconnected by fluid pressure actuation of a releasable catch.

4. A method of setting an electrical motor actuated liquid pump in a well comprising, attaching a retrievable support means to the motor and pump, lowering and setting the pump in the well, disconnecting the support means from the motor after the pump is set, retrieving the support means from the well, and lowering and connecting an electrical cable to the motor, said cable being an insulated electrical conductor enclosed in a lower tensile strength corrosion-resistant metal tubing.

5. An electrical motor operated well pump for setting in a well comprising, an electrical cable adapted to be connected to the motor, said cable being one or more insulated electrical conductors enclosed in a low tensile strength corrosion-resistant metal tubing, said metal tubing having the tensile strength to support the tubing and the electrical conductor, and separate retrievable and releasable support means connected to the pump and motor, said support means having the tensile strength to support the motor and pump in the well.

6. The pump of claim 5 wherein said support means includes a wire rope used temporarily and without requiring corrosion-resistant properties.

7. The system of claim 5 wherein said support means includes a metal tube.

8. The system of claim 5 wherein the insulated electrical conductors are at least two and include a diameter and are twisted to provide a lay length and the lay length of the conductors is approximately eight to fourteen times the diameter of an insulated conductor.

9. The system of claim 6 including, tension actuated releasable catch means connecting the wire rope to the motor and pump.

10. The system of claim 7 including, fluid pressure actuated releasable catch means connecting the metal tube to the motor and pump.

11. The system of claim 5 wherein said electrical cable is subsurface connectible and disconnectible.

12. The system of claim 5 wherein the electrical cable includes, one or more hydraulic tubes extending through the cable interiorly of the metal tubing.

13. The system of claim 5 wherein the metal tubing is a low alloy steel having a tensile strength criteria sufficient to support the tubing and the electrical conductor but not the motor and pump.

* * * * *